US010369759B2

(12) United States Patent
Totani

(10) Patent No.: US 10,369,759 B2
(45) Date of Patent: Aug. 6, 2019

(54) PLASTIC BAG MAKING APPARATUS

(71) Applicant: Totani Corporation, Kyoto (JP)

(72) Inventor: Mikio Totani, Kyoto (JP)

(73) Assignee: Totani Corporation, Kyoto (JP)

( * ) Notice: Subject to any disclaimer, the term of this patent is extended or adjusted under 35 U.S.C. 154(b) by 332 days.

(21) Appl. No.: 15/451,501

(22) Filed: Mar. 7, 2017

(65) Prior Publication Data

US 2017/0173913 A1 Jun. 22, 2017

Related U.S. Application Data

(62) Division of application No. 14/134,158, filed on Dec. 19, 2013, now abandoned.

(30) Foreign Application Priority Data

Dec. 28, 2012 (JP) ..... 2012-287295

(51) Int. Cl.
*B65D 30/20* (2006.01)
*B65D 33/25* (2006.01)
(Continued)

(52) U.S. Cl.
CPC ..... *B31B 50/18* (2017.08); *B31B 50/10* (2017.08); *B31B 50/26* (2017.08); *B31B 50/64* (2017.08);
(Continued)

(58) Field of Classification Search
CPC ..... B31B 70/20; B31B 70/81; B31B 50/18; B31B 50/81; B31B 50/814; B31B 70/266;
(Continued)

(56) References Cited

U.S. PATENT DOCUMENTS 4,273,550 A * 6/1981 Kamp ..... B31B 70/00 493/240
4,610,651 A 9/1986 Jacobson
(Continued)

FOREIGN PATENT DOCUMENTS

DE 102005057669 6/2007
EP 1754596 2/2007
(Continued)

OTHER PUBLICATIONS

Australian SearchReport in counterpart Australian application No. 2013270558 dated Jun. 3, 2015.
(Continued)

*Primary Examiner* — Alexander M Valvis
*Assistant Examiner* — Lucas E. A. Palmer

(57) ABSTRACT

In order to successively make plastic bags each of which includes panel portions, side gusset portions and a zipper portion, a web of panel material 9 is folded and folded back along longitudinal folded lines 14, 15 and 16 and longitudinal folded back lines 17 and 18 into superposed two layers having opposite side edges at each of which a folded portion is formed. The web of panel material 9 is slit along the longitudinal folded line 16 into two divided parts after being folded and folded back. The divided parts are separated and spaced from each other. In addition, the folded portions are split at positions into sprit portions and removed at the positions partially, a body of zipper material being disposed between the sprit portions.

2 Claims, 6 Drawing Sheets

A

B

C

(51) Int. Cl.

| | |
|---|---|
| ***B31B 50/18*** | (2017.01) |
| ***B31B 50/10*** | (2017.01) |
| ***B31B 50/26*** | (2017.01) |
| ***B31B 50/64*** | (2017.01) |
| ***B31B 50/81*** | (2017.01) |
| ***B31B 70/00*** | (2017.01) |
| *B31B 70/10* | (2017.01) |
| *B31B 70/18* | (2017.01) |
| *B31B 155/00* | (2017.01) |
| *B31B 160/20* | (2017.01) |
| *B31B 70/14* | (2017.01) |
| *B31B 70/26* | (2017.01) |
| *B31B 70/81* | (2017.01) |

(52) U.S. Cl.
CPC ..... *B31B 50/81* (2017.08); *B31B 70/00* (2017.08); *B65D 31/10* (2013.01); *B65D 33/2508* (2013.01); *B31B 70/10* (2017.08); *B31B 70/148* (2017.08); *B31B 70/18* (2017.08); *B31B 70/262* (2017.08); *B31B 70/266* (2017.08); *B31B 70/8133* (2017.08); *B31B 2155/00* (2017.08); *B31B 2155/0012* (2017.08); *B31B 2160/20* (2017.08)

(58) Field of Classification Search
CPC ..... B31B 70/16; B31B 70/61; B31B 70/8123; B31B 70/813
USPC ..... 493/213, 214, 927
See application file for complete search history.

(56) References Cited

U.S. PATENT DOCUMENTS

| | | | | |
|---|---|---|---|---|
| 4,736,450 | A | 4/1988 | Van Erden | |
| 4,840,611 | A | 6/1989 | Van Erden | |
| 5,275,491 | A * | 1/1994 | Kuge | B65D 33/2533 383/120 |
| 5,364,189 | A | 11/1994 | Kuge | |
| 5,890,810 | A | 4/1999 | Barlow | |
| 6,068,585 | A | 5/2000 | Ouchi | |
| 6,261,000 | B1 | 7/2001 | Bois | |
| 6,425,847 | B1 | 7/2002 | Broenstrup | |
| 6,488,222 | B1 | 12/2002 | West | |
| 6,561,963 | B2 | 5/2003 | Totani | |
| 6,692,148 | B2 | 2/2004 | Totani | |
| 6,807,794 | B2 | 10/2004 | Ausnit | |
| 7,204,641 | B2 * | 4/2007 | Stolmeier | B65D 31/10 383/120 |
| 7,490,451 | B2 | 2/2009 | Matthews | |
| 7,506,487 | B2 | 3/2009 | Eads | |
| 7,775,957 | B2 * | 8/2010 | Totani | B65D 31/10 493/189 |
| 8,137,254 | B2 | 3/2012 | DeSmedt | |
| 8,226,534 | B2 | 7/2012 | Chaturvedi | |
| 8,257,235 | B2 | 9/2012 | Dytchkowskyj | |
| 8,414,465 | B2 | 4/2013 | Totani | |
| 9,475,248 | B1 * | 10/2016 | Russell | B65D 75/008 |
| 2001/0023571 | A1 * | 9/2001 | Bois Henri | B65D 31/10 53/410 |
| 2001/0038721 | A1 | 11/2001 | Bois | |
| 2002/0103067 | A1 | 8/2002 | Bois | |
| 2007/0133908 | A1 * | 6/2007 | Bruns | B65D 31/10 383/95 |
| 2007/0148382 | A1 * | 6/2007 | Koehn | B29C 53/10 428/35.2 |
| 2007/0258665 | A1 | 11/2007 | Greco | |
| 2008/0085823 | A1 * | 4/2008 | Reggi | B31B 70/00 493/189 |
| 2008/0205801 | A1 * | 8/2008 | Alaux | B65D 31/10 383/120 |
| 2010/0069212 | A1 | 3/2010 | Chaturvedi | |
| 2010/0290722 | A1 * | 11/2010 | DeSmedt | B65D 31/10 383/120 |
| 2011/0039676 | A1 | 2/2011 | Totani | |
| 2011/0077139 | A1 * | 3/2011 | Kujat | B31B 70/00 493/267 |
| 2014/0364292 | A1 | 12/2014 | Tan | |

FOREIGN PATENT DOCUMENTS

| | | |
|---|---|---|
| EP | 1795335 | 6/2007 |
| JP | 07024941 | 1/1995 |
| JP | 20030170510 | 6/2003 |
| WO | 2005105592 | 11/2005 |
| WO | 2006092517 | 9/2006 |

OTHER PUBLICATIONS

European Search Report issued in counterpart European application No. 13197373.7, dated Nov. 15, 2016.

* cited by examiner

A

B

A

B

A

B

C

A

B

PLASTIC BAG MAKING APPARATUS

TECHNICAL FIELD

The invention relates to an apparatus for successively making plastic bags.

BACKGROUND

There has been proposed an apparatus for successively making plastic bags each of which includes panel portions, side gusset portions and a zipper portion, as disclosed in U.S. Pat. No. 8,414,465.

In the apparatus of the patent, two webs of panel material are superposed with each other and fed longitudinally thereof. Two webs of side gusset material are supplied onto one of the webs of panel material to extend longitudinally thereof before the webs of panel material are superposed with each other. The webs of side gusset material are then sprit every a length into sheets of side gusset material, the sheets of side gusset material being spaced from each other longitudinally of the webs of panel material. In addition, a body of zipper material is supplied onto one of the webs of panel material to extend widthwise thereof, the body of zipper material being disposed between the sheets of side gusset material. The sheets of side gusset material and the body of zipper material are then interposed between the webs of panel material when the webs of panel material are superposed with each other. Furthermore, the webs of panel material and the sheets of side gusset material are heat sealed with each other longitudinally of the webs of panel material after the webs of panel material are superposed with each other. The webs of panel material and the body of zipper material are heat sealed with each other widthwise of the webs of panel material after the webs of panel material are superposed with each other. The panel portions, the side gusset portions and the zipper portion are therefore formed by the webs of panel material, the sheets of side gusset material and the body of zipper material.

In this case, the apparatus involves not only a panel material supplying device by which the webs of panel material are supplied and a zipper material supplying device by which the body of zipper material is supplied but also a side gusset material supplying device by which the webs of side gusset material are supplied. The apparatus must therefore be complicated in structure and high in cost. In addition, the apparatus is large sized by the side gusset material supplying device. A large space is therefore required for installation. When being printed with a pattern, differences in extension may come between the webs of panel material and the webs of side gusset material to be accumulated, resulting in discrepancy in pattern.

Another apparatus has also be proposed to successively make plastic bags each of which includes panel portions, side gusset portions and a bottom gusset portion, as disclosed in U.S. Pat. No. 6,692,148.

In the apparatus of the patent, a web of panel material is folded and folded back along longitudinal folded lines and longitudinal folded back line into superposed two layers having opposite side edges at each of which a folded portion is formed, the folded portion being folded into halves and interposed between the layers. The apparatus includes a Thomson blade by which one of the layers of panel material is cross cut along with the folded portions, the other layer of panel material being kept from being cross cut, so that an opening should be formed in the web of panel material. A sheet of bottom gusset material is then inserted between the layers of panel material through the opening. The side gusset portions and the bottom gusset portion can therefore be formed by the folded portions and the sheet of bottom gusset material. The webs of side gusset material have not to be supplied.

However, in the apparatus, the body of zipper material cannot be interposed between the layers of panel material by reason that the side gusset portions are formed by the folded portions. Accordingly, the apparatus can merely make the plastic bag including the bottom gusset portion. It cannot make the plastic bag including the zipper portion.

It is therefore an object of the invention to provide an apparatus which can successively make plastic bags each of which includes panel portions, side gusset portions and a zipper portion, with no web of side gusset material being supplied.

SUMMARY OF THE INVENTION

According to the invention, the apparatus comprises a panel material feeding device by which a web of panel material is fed longitudinally thereof. The apparatus further comprises a panel material guide device by which the web of panel material is guided when being fed to be folded and folded back along longitudinal folded lines and longitudinal folded back lines into superposed two layers having opposite side edges at each of which a folded portion is formed, the folded portion being folded into halves and interposed between the layers. The apparatus further comprises a slitting device by which the web of panel material is slit along the longitudinal folded line into two divided parts after being folded and folded back so that one of the divided parts should include the folded portions formed therein. The apparatus further includes a divided parts guide device by which the divided parts are guided when being fed to be separated and spaced from each other, fed as they are and then superposed with each other. The apparatus further comprises a splitting and removing device by which the folded portions are split at positions into split portions and removed at the positions partially after the divided parts are separated and spaced from each other so that the split portions should be spaced from each other. The apparatus further comprises a zipper material supplying device by which a body of zipper material is supplied onto one of the divided parts to extend widthwise thereof, the body of zipper material being disposed between the sprit portions. The body of zipper material is then interposed between the divided parts when the divided parts are superposed with each other. The apparatus further comprises a longitudinal seal device by which the divided parts are heat sealed with each other longitudinally thereof after being superposed with each other. The apparatus further comprises a cross seal device by which the divided parts and the body of zipper material are heat sealed with each other widthwise of the divided parts after the divided parts are superposed with each other. The panel portions, the side gusset portions and the zipper portion are therefore formed by the divided parts, the folded portions and the body of zipper material.

In a preferred embodiment, the web of panel material includes a center portion disposed between first and second side edges. The longitudinal folded lines comprise first, second and third folded lines, the first folded line extending near the first side edge of panel material. The longitudinal folded back lines comprise first and second folded back lines, the first folded back line extending between the first side edge of panel material and the first folded line. The second and third folded lines extend along the center portion of panel material. The second folded back line extends between the second and third folded lines. The web of panel material is folded along the first folded line and folded back along the first folded back line so that one of the folded portions should be formed near the first side edge of panel material. The web of panel material is further folded along the second folded line, folded back along the second folded back line and folded along the third folded line so that the other folded portion should be formed at the center portion of panel material. The web of panel material is then slit along the third folded line into the divided parts.

The web of panel material is firstly folded along the first folded line, folded back along the first folded back line, folded along the second folded line and folded back along the second folded back line. The web of panel material is then folded along the third folded line.

BEST MODE TO CARRY OUT THE INVENTION

Figure 1:
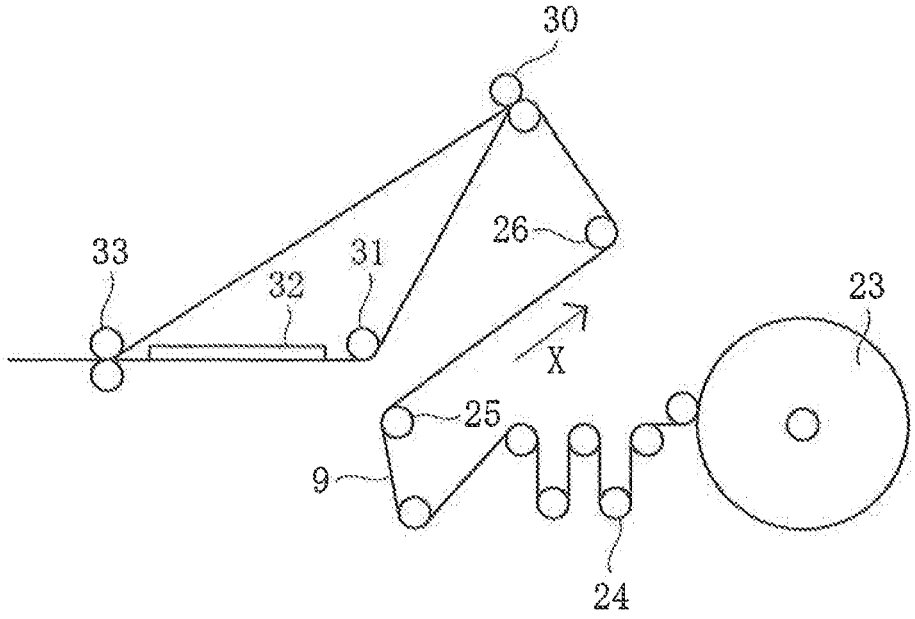
FIG. 1 is a side view (A) of a preferred embodiment of the invention and a plan view (B) of the web of panel material of (A).
Figure 1:
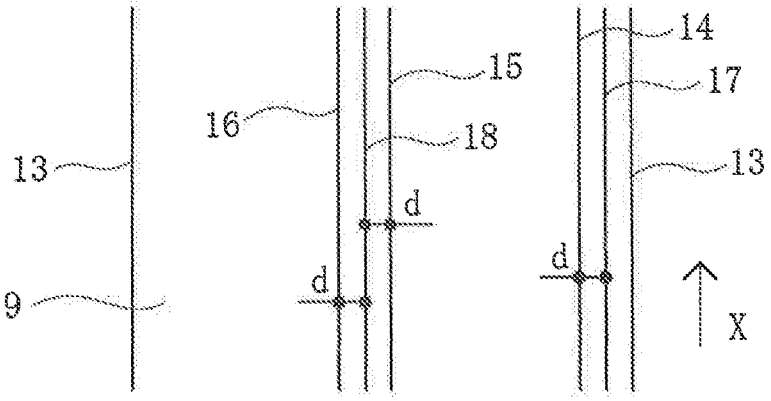
Figure 6:
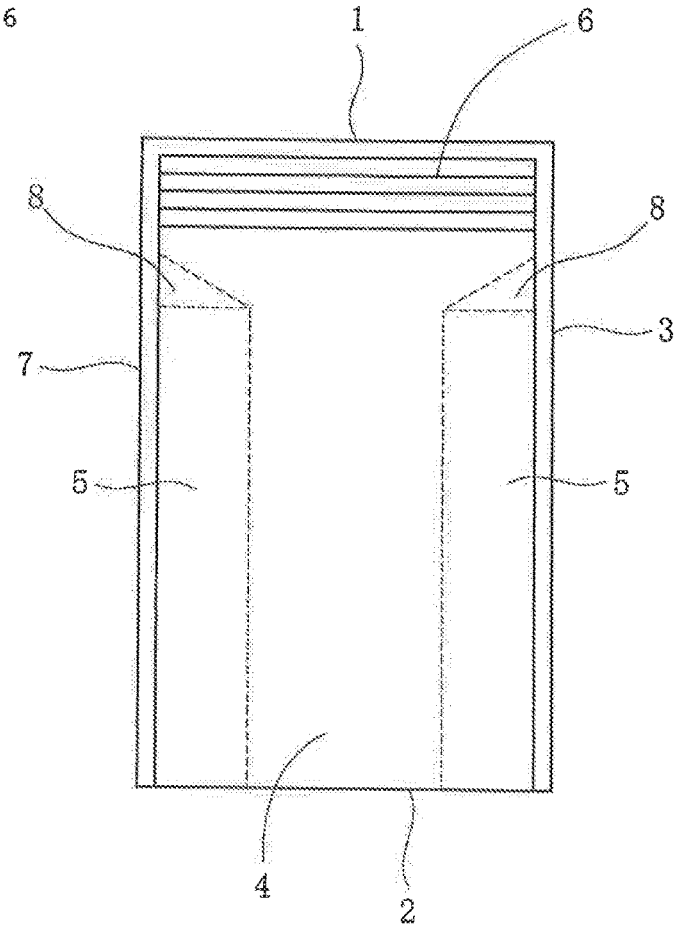
FIG. 6 is a plan view of a plastic bag obtained by the apparatus of FIG. 1.

Turning now to the drawings, FIG. 1 illustrates an apparatus for successively making plastic bags, according to the invention, each of which has a rectangular and tall structure and includes a top edge 1, a bottom edge 2 and side edges 3, as shown in FIG. 6. The plastic bag includes panel portions 4, side gusset portions 5 and a zipper portion 6, the panel portions 4 comprising superposed two layers of panel material. The side gusset portions 5 extend along the side edges 3 of plastic bag, as in the case of plastic bag of U.S. Pat. No. 8,414,465. In addition, the side gusset portion 5 is folded into halves and interposed between the panel portions 4. The zipper portion 6 extends along the top edge 1 of plastic bag to be interposed between the panel portions 4. The panel portions 4 are heat sealed with the side gusset portions 5 so that heat seal portions 7 should be formed along the side edges 3 of plastic bag. The panel portions 4 are heat sealed with the zipper portion 6 and heat sealed with each other so that heat seal portions 7 should be formed along the top edge 1 of plastic bag. The zipper portion 6 may be called a fastener portion and has been used generally in itself. It includes a male member formed integrally with a tape and fitted into a female member which is also formed integrally with a tape. The panel portions 4 are heat sealed with the tapes of male and female members.

In the plastic bag, each of the panel portions 4 and the side gusset portions 5 comprises a laminate film composed of a base material and a sealant. The panel portions 4 have inner surfaces formed by the sealant and outer surfaces formed of the base material. The side gusset portions 5 have outer surfaces formed by the sealant and inner surfaces formed by the base portion when being folded into halves, as also in the case of plastic bag of the patent.

In the plastic bag, each of the side gusset portions 5 has opposite end portions one of which is folded obliquely along an oblique folded line as it is folded into halves at a position near the zipper portion 6. A triangular flap 8 is therefore formed by the end portion to be shaped into a triangle having a hypotenuse formed by the oblique folded line. The triangle has an apex formed by an intersection between the end edge and the folded edge of side gusset portion 5. The panel portions 4, the side gusset portions 5 and the triangular flap 8 are heat sealed respectively along the side edges 3 of plastic bag. The panel portions 4 and the side gusset portions 5 can therefore be closed to each other with a sealing strength enough to be free of leakage from the end portion of side gusset portions 5, as also in the case of plastic bag of the patent.

Figure 4:
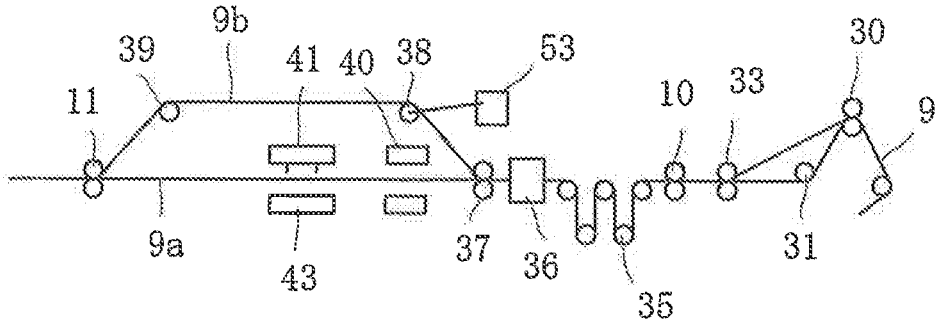
FIG. 4 is a side view (A) of the slitting device, the divided parts guide device and the splitting and removing device of FIG. 1, a plan view (8) of the splitting and removing device and the zipper material supplying device of (A) and an enlarged view (C) of the guide plate and the spatula of (B).
Figure 4:
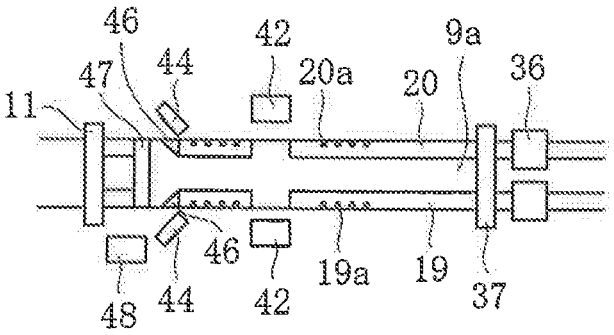
Figure 4:
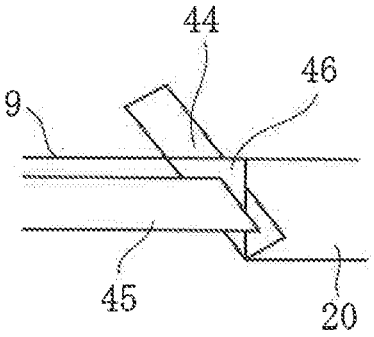
Figure 5:
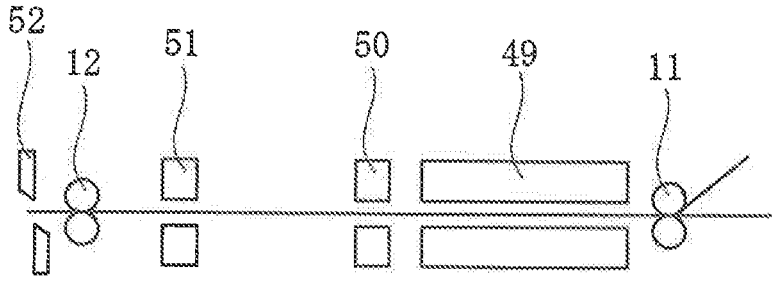
FIG. 5 is a side view (A) of the longitudinal seal device and the cross seal device of FIG. 1 and a plan view (B) of the longitudinal seal device and the cross seal device of (A).
Figure 5:
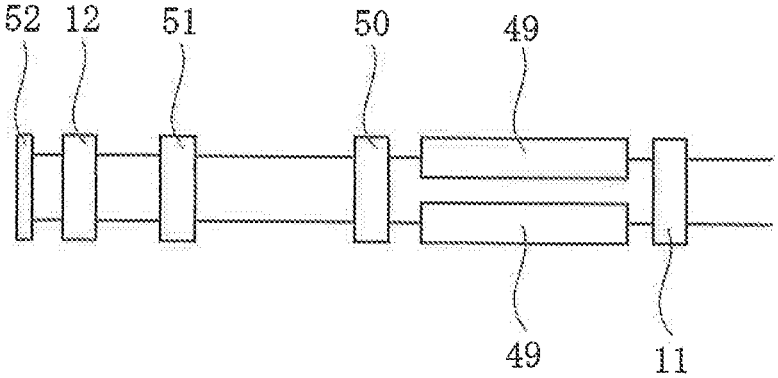

In order to successively make the plastic bags of FIG. 6, the apparatus includes a panel material feeding device by which a web of panel material 9 is fed longitudinally thereof. In the embodiment, the panel material feeding device comprises feeding rollers 10, 11 and 12, as shown in FIGS. 4 and 5. The web of panel material 9 is directed to the feeding rollers 10, 11 and 12 so that the web of panel material 9 should be fed by the feeding rollers 10, 11 and 12. The feeding rollers 10 are rotated continuously so that the web of panel material 9 should be fed continuously. The feeding rollers 11 and 12 are rotated intermittently so that the web of panel material 9 should be fed intermittently.

Figure 2:
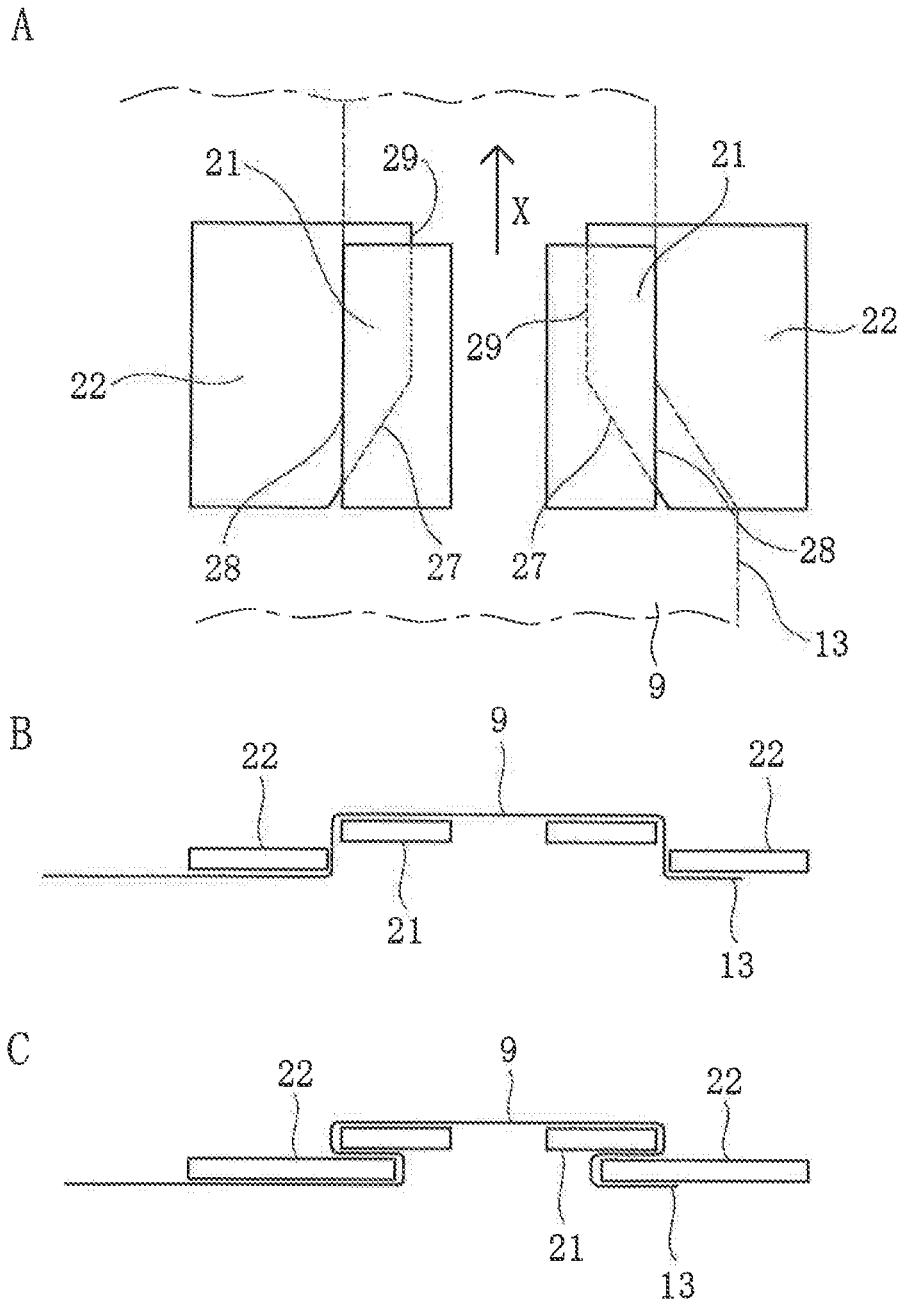
FIG. 2 is a plan view (A) of the panel material guide device of FIG. 1, a sectional view (B) of the panel material guide device of (A) and a sectional view (C) of different position.
Figure 3:
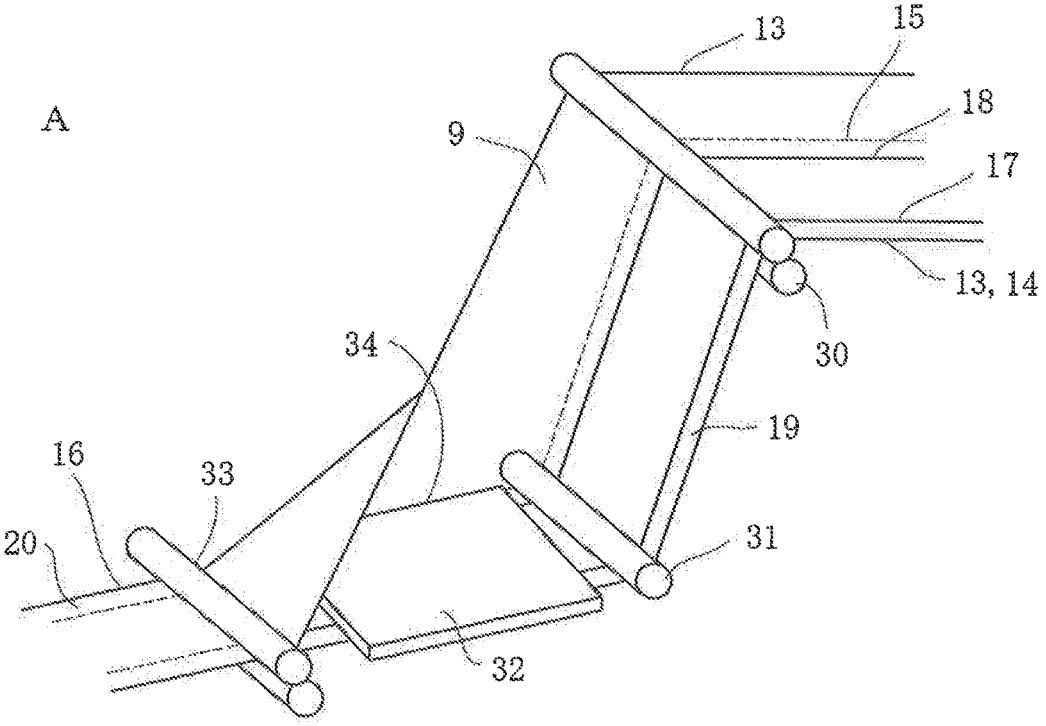
FIG. 3 is a perspective view (A) of the panel material guide device of FIG. 1 and a sectional view of the web of panel material of (A).
Figure 3:
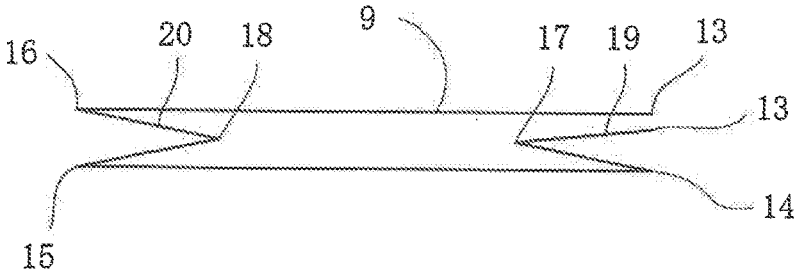

The web of panel material 9 comprises a plastic film printed with a pattern over again and having a width to include first and second side edges 13. The apparatus further includes a panel material guide device by which the web of panel material 9 is guided when being fed to be folded and folded back along longitudinal folded lines 14, 15 and 16 and longitudinal folded back lines 17 and 18 into superposed two layers having opposite side edges at each of which a folded portion 19 and 20 is formed, the folded portion 19 and 20 being folded into halves and interposed between the layers, as shown in FIGS. 2 and 3. The apparatus further includes a slitting device by which the web of panel material 9 is slit along the longitudinal folded line 16 into two divided parts 9*a* and 9*b* after being folded and folded back so that one of the divided parts 9*a* should include the folded portions 19 and 20 formed therein.

In the embodiment, the web of panel material 9 includes a center portion disposed between the first and second side edges 13. The longitudinal folded lines 14, 15 and 16 comprise first, second and third folded lines, the first folded line 14 extending near the first side edge 13 of panel material. The longitudinal folded back lines 17 and 18 comprise first and second folded back lines, the first folded back line 17 extending between the first side edge 13 of panel material and the first folded line 14. The second and third folded lines 15 and 16 extend along the center portion of panel material. The second folded back line 18 extends between the second and third folded lines 15 and 16. The first folded line 14 is spaced from the first folded back line 17, the second and third folded lines 15 and 16 being spaced from the second folded back line 18, at a distance d widthwise of the web of panel material 9. The web of panel material 9 is folded along the first folded line 14 and folded back along the first folded back line 17 so that one of the folded portions 19 should be formed near the first side edge 13 of panel material. The web of panel material 9 is further folded along the second folded line 15, folded back along the second folded back line 18 and folded along the third folded line 16 so that the other folded portion 20 should be formed at the center portion of panel material. The web of panel material 9 is then slit along the third folded line 16 into the divided parts 9*a* and 9*b*.

In the embodiment, the web of panel material 9 is firstly folded along the first folded line 14, folded back along the first folded back line 17, folded along the second folded line 15 and folded back along the second folded back line 18. The web of panel material 9 is then folded along the third folded line 16.

For example, the panel material guide device comprises first and second guide devices. The first guide device includes inner and outer plates 21 and 22. The web of panel material 9 is supplied from a roll 23, engaged with dancer rollers 24 and directed to guide rollers 25 and 26. The inner and outer plates 21 and 22 are interposed between the guide rollers 25 and 26 so that the web of panel material 9 is turned by the guide roller 25 and then directed to the inner and outer plates 21 and 22. The inner and outer plates 21 and 22 are disposed parallel to the web of panel material 9 to extend in a direction X in which the web of panel material 9 is fed. The outer plate 22 comprises two plates spaced from each other widthwise of the panel of panel material 9. The inner plate 21 comprises two plates interposed between the outer plates 22 so that the web of panel material 9 should be directed to the inner plate 21 on the upper side thereof and directed to the outer plate 22 on the Rawer side thereof (FIG. 2 B). In addition, in the outer plate 22, the two plates include inclined edges 27 formed thereon. The inner and outer plates 21 and 22 include parallel edges 28 and 29 formed thereon. The inner and outer plates 21 and 22 are superposed with each other partially so that the parallel edges 28 extend along the first and second folded lines 14 and 15, the parallel edges 29 extending along the first and second folded back lines 17 and 18. The web of panel material 9 is therefore guided by the inner and outer plates 21 and 22 when being fed to be deformed by the inclined edges 27, folded along the parallel edges 28 and folded back along the parallel edges 29 (FIG. 2 C). As a result, the web of panel material 9 is folded along the first folded line 14 and folded back along the first folded back line 17 so that one of the folded portion 19 should be formed near the first side edge 13 of the web of panel material 9. In addition, the web of panel material 9 is folded along the second folded line 15 and folded back along the second folded back line 18. The web of panel material 9 is folded downwardly when being folded along the first and second folded lines 14 and 15.

The second guide device includes guide rollers 30 and 31, a guide plate 32 and guide rollers 33. The web of panel material 9 is engaged with the guide rollers 26 and 30 to be turned again after being folded and folded back. The web of panel material 9 is then directed to the guide roller 31, the guide plate 32 and the guide rollers 33. The guide roller 31 includes opposite end portions one of which is disposed on the third folded line 16 while the guide plate 32 includes a guide edge 34 formed thereon and extending along the third folded line 16. The web of panel material 9 is guided by the guide rollers 30 and 31 to be lowered by the guide roller 31. In addition, the web of panel material 9 is folded by the guide roller 31 at the end portion thereof to stand up. The web of panel material 9 is then guided by the guide plate 32 and the guide rollers 33 to be folded along the guide edge 34. The web of panel material 9 is directed to and sandwiched between the guide rollers 33 to be folded completely. It should therefore be understood that the web of panel material 9 is folded along the third folded line 16. The web of panel material 9 is folded upwardly when being folded along the third folded line 16. In this connection, it should be noted that the web of panel material 9 is folded downwardly when being folded along the first and second folded lines 14 and 15. The web of panel material 9 is then turned again, as described previously. The web of panel material 9 is therefore folded in the same direction into superposed two layers when being folded along the third folded line 16 so that the other folded portion 20 should be formed at the center portion of the web of panel material 9. The web of panel material 9 includes the first and second side edges 13 which are coincide with each other when being folded along the third folded line 16.

The web of panel material 9 is then directed to the feeding rollers 10 and fed continuously to be engaged with dancer rollers 35 and directed to the slitting device. Subsequently, the web of panel material 9 is directed to the feeding rollers 11 and fed intermittently. The web of panel material 9 is slit along the third folded line 16 into two divided parts 9*a* and 9*b* when passing through the slitting device. For example, the slitting device includes a slitting blade 36, the web of panel material 9 passing through the slitting blade 36 to be slit by the slitting blade 36. One of the divided parts 9*a* therefore includes the folded portions 19 and 20 formed therein.

The apparatus further includes a divided parts guide device by which the divided parts 9*a* and 9*b* are guided when being fed to be separated and spaced from each other, fed as they are and then superposed with each other. For example, the divided parts guide device includes guide rollers 37, 38 and 39, the divided parts 9*a* and 9*b* being directed to the guide rollers 37 after being slit. One of the divided parts 9*a* is then fed without change while the other divided part 9*b* is directed to the guide roller 38 to be pulled upwardly. The divided parts 9*a* and 9*b* are therefore guided by the guide rollers 37 and 38 to be separated from each other. The divided part 9*b* is then directed to the guide roller 39 so that the divided parts 9*a* and 9*b* should be separated and spaced from each other and fed as they are. The divided parts 9*a* and 9*b* are then directed to the feeding rollers 11 to be superposed with each other and fed intermittently.

The apparatus further includes a splitting and removing device by which the folded portions 19 and 20 are split at positions into split portions and removed at the positions partially after the divided parts 9*a* and 9*b* are separated and spaced from each other so that the split portions should be spaced from each other. For example, the slitting device includes slitting blades 36, the web of panel material 9 passing through the slitting blades 36 to be slit not only along the third folded line 16 but also along the first and second folded lines 14 and 15. The folded portions 19 and 20 and the divided part 9*a* are therefore divided from each other once. The divided parts 9*a* and 9*b* are then guided by the guide rollers 37 and 38 to be separated from each other. One of the divided parts 9*a* is directed to a temporarily fixing device by which the folded portions 19 and 20 and the divided part 9*a* are fixed to each other temporarily along the slit lines after the divided part 9*a* are 9*b* are separated. For example, the temporarily fixing device comprises a heat seal or ultrasonic device 40 by which the folded portions 19 and 20 and the divided part 9*a* are heat sealed or ultrasonic sealed with and fixed to each other to make temporarily fixed portions 19*a* and 20*a* formed. The folded portions 19 and 20 are then fed by the temporarily fixed portions 19*a* and 20*a*. In addition, the folded portions 19 and 20 and the divided part 9*a* are heat sealed or ultrasonic sealed with each other partially when being fixed to each other temporarily, to have unfixed portions not fixed to each other.

The splitting and removing device includes Thomson blades 41 and claws 42, the Thomson blades 41 being pressed against the folded portions 19 and 20, the divided part 9*a* and a receiver 43 at the unfixed portion when the divided parts 9*a* and 9*b* are stopped temporarily whenever being fed intermittently. The Thomson blades 41 are the same as those disclosed in U.S. Pat. No. 6,692,148. The folded portions 19 and 20 and the divided part 9*a* are sandwiched between the Thomson blades 41 and the receiver 43 so that the folded portions 19 and 20 should be cross cut by the Thomson blades 41 widthwise of the divided part 9*a*. The divided part 9*a* is kept from being cross cut. This step is performed repeatedly whenever the divided parts 9*a* and 9*b* are fed intermittently so that the folded portions 19 and 20 should be split every a length into sprit portions. The Thomson blades 41 are spaced from each other longitudinally of the divided part 9*a* and pressed against the folded portions 19 and 20 so that the folded portions 19 and 20 should be cross cut at positions of Thomson blades 41. The claws 42 are then moved widthwise of the divided part 9*a* and engaged with the folded portions 19 and 20 between the positions at which the folded portions 19 and 20 are cross cut, after the Thomson blades 41 are moved back where they were and disengaged from the folded portions 19 and 20. In addition, the claws 42 are moved reversely so that the folded portions 19 and 20 should be moved by the claws 42 to be drawn from the divided part 9*a*. It should therefore be understood that the folded portions 19 and 20 are split at positions into sprit portions and removed at the positions partially so that the split portions should be spaced from each other.

In addition, for example, guide plates 44 are superposed with the folded portions 19 and 20 so that the folded portions 19 and 20 should be held by the guide plate 44 after being split and removed and when the divided parts 9*a* and 9*b* are stopped temporarily whenever being fed intermittently. Spatulas 45 are then inserted between the folded portions 19 and 20 and the divided part 9*a*. The folded portions 19 and 20 are taken up by the spatulas 45 and folded along the guide plates 44 at the end portion of the folded portions 19 and 20 to make the triangular flap 46 formed, as in the case of the apparatus of U.S. Pat. No. 8,414,465.

The apparatus further includes a zipper material supplying device by which a body of zipper material 47 is supplied onto and put on one of the divided parts 9*a* to extend widthwise thereof, the body of zipper material 47 being disposed between the sprit portions of folded portions 19 and 20. For example, the zipper material supplying device includes an auto hand 48 by which the body of zipper material 47 is supplied after the folded portions 19 and 20 are split and removed and when the divided parts 9*a* and 9*b* are stopped temporarily whenever being fed intermittently. The apparatus may include a temporarily fixing device by which the body of zipper material 47 and the divided part 9*a* are fixed to each other temporarily. The temporarily fixing device may comprise a heat seal or ultrasonic seal device by which the body of zipper material 47 and the divided part 9*a* are heat sealed or ultrasonic sealed with and fixed to each other temporarily, as also in the case of the apparatus of the patent.

In the apparatus, the folded portions 19 and 20 and the body of zipper material 47 are therefore interposed between the divided parts 9*a* and 9*b* when the divided parts 9*a* and 9*b* are superposed with each other.

The apparatus further includes a longitudinal seal device 49 by which the divided parts 9*a* and 9*b* are heat sealed with each other longitudinally thereof so that longitudinal sealed portions should be formed on the divided parts 9*a* and 9*b*, after the divided parts 9*a* and 9*b* are superposed with each other and when the divided parts 9*a* and 9*b* are stopped temporarily whenever being fed intermittently. When being heat sealed, the divided part 9*b* and the folded portions 19 and 20 are heat sealed with each other while the folded portions 19 and 20 and the divided part 9*a* are heat sealed with each other.

The apparatus further includes a cross seal device 50 by which the divided parts 9*a* and 9*b* and the body of zipper material 47 are heat sealed with each other widthwise of the divided parts 9*a* and 9*b* after the divided parts 9*a* and 9*b* are superposed with each other and when the divided parts 9*a* and 9*b* are stopped temporarily whenever being fed intermittently. The apparatus further includes a cross seal device 51 by which the divided parts 9*a* and 9*b* are heat sealed with each other widthwise thereof so that a cross sealed portion should be formed on the divided parts 9*a* and 9*b* when the divided parts 9*a* and 9*b* are stopped temporarily whenever being fed intermittently.

The apparatus further includes a cutter 52 by which the divided parts 9*a* and 9*b* are cross cut widthwise thereof when the divided parts 9*a* and 9*b* are stopped temporarily whenever being fed intermittently. The divided parts 9*a* and 9*b* are cross cut at a position corresponding to the cross sealed portion.

In the plastic bag, the panel portions 4, the side gusset portions 5 and the zipper portion 6 are therefore formed by the divided parts 9*a* and 9*b*, the folded portions 19 and 20 and the body of zipper material 47. The side edges 3 are formed by the longitudinal sealed portions while the top edge 1 is formed by the cross sealed portion.

In the apparatus, a discrepancy in pattern may come between the divided parts 9*a* and 9*b* by reason that the divided part 9*a* is fed without change while the divided part 9*b* is directed to the guide roller 38 to be pulled upwardly in the divided parts guide device. It is therefore preferable that a drive 53 is connected to the guide roller 38 so that the guide roller 38 should be moved by the drive 53 for adjustment of position, conformity in pattern being obtained between the divided parts 9*a* and 9*b*.

The divided part 9*a* may be directed to guide rollers to be pulled downwardly when the divided part 9*b* is directed to the guide rollers 38 and 39 to be pulled upwardly. The divided parts 9*a* and 9*b* are then directed to the feeding rollers 11 to be superposed with each other so that the divided parts 9*a* and 9*b* should have the same length as each other between the guide rollers 37 and the feeding rollers 11.

Accordingly, in the apparatus, the side gusset portions 5 can be formed by the folded portions 19 and 20. In addition, the web of panel material 9 is slit along the longitudinal folded line 16 into two divided parts 9*a* and 9*b*. The divided parts 9*a* and 9*b* are separated and spaced from each other. The folded portions 19 and 20 are then split at positions into sprit portions and removed at the positions partially so that the split portions of folded portions 19 and 20 should be spaced from each other. The body of zipper material 47 is then interposed between the sprit portions of folded portions 19 and 20 so that the zipper portion 6 should be formed by the body of zipper material 47. The divided parts 9*a* and 9*b* can therefore be kept being separated and spaced from each other when the folded portions 19 and 20 are split and removed and when the body of zipper material 47 is interposed. As a result, the folded portions 19 and 20 can be split and removed without difficulty. The body of zipper material 47 can be interposed without difficulty. The side gusset portions 5 and the zipper portion 6 can be incorporated into the plastic bag, with no web of side gusset material being supplied.

The apparatus has not to involve a side gusset material supplying device by which the webs of side gusset material are supplied. The apparatus is therefore neither complicated in structure nor high in cost. In addition, the apparatus is not large sized by the side gusset material supplying device. A large space is therefore not required for installation. When being printed with a pattern, the apparatus has no problem of differences in extension coming between the webs of panel material and the webs of side gusset material to be accumulated, resulting in discrepancy in pattern, unlike the apparatus of the patent.

In the apparatus, the plastic bag has a height in a direction which is longitudinal of the web of panel material 9. The apparatus can therefore successively make the plastic bags each of which has a tall structure without using a web of panel material which is wide, and without difficulty.

The triangular flap 46 is formed at one of the opposite end portions of folded portions 19 and 20, as described previously. In this connection, the apparatus may include a bottom gusset material supplying device by which a sheet of bottom gusset material is supplied to the divided parts 9*a* and 9*b* to extend widthwise thereof, as described in U.S. Pat. No. 8,414,465. The sheet of bottom gusset material is combined with the folded portions 19 and 20 at the other end portion thereof. The apparatus includes a cross seal device by which divided parts 9*a* and 9*b* and the sheet of bottom gusset material are heat sealed with each other so that the plastic bag should include a bottom gusset portion formed by the sheet of bottom gusset material.

Figure 7:
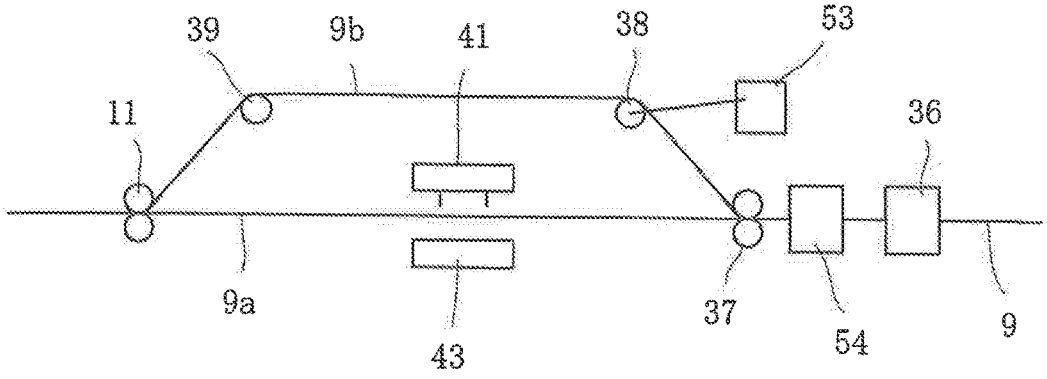
FIG. 7 is a side view of another embodiment.

FIG. 7 illustrates another embodiment. In the embodiment, the slitting device includes a slitting blade 36 by which the web of panel material 9 is slit along the third folded line 16 when passing through the slitting blade 36. The web of panel material 9 is not slit along the first and second folded lines 14 and 15. In addition, the web of panel material 9 passes through perforating blades 54 so that perforations are formed along the first and second folded lines 14 and 15. The craws 42 are then engaged with the folded portions 19 and 20 so that the folded portions 19 and 20 should be pulled by the craws 42 to be torn along the perforations after being cross cut by the Thomson blades 41. The folded portions 19 and 20 can therefore be drawn from the divided part 9*a* to be removed at positions partially. In this case, the folded portions 19 and 20 can be fed by the perforations. The folded portions 19 and 20 and the divided part 9*a* have therefore not to be fixed to each other temporarily by the heat seal or ultrasonic seal device 40.

What is claimed is:

1. A method of successively making plastic bags each of which includes panel portions, side gusset portions and a zipper portion, the method comprising:

feeding a web of panel material longitudinally thereof;

guiding the web of panel material when being fed to be folded and folded back along longitudinal folded lines and longitudinal folded back lines into superposed two layers having opposite side edges at each of which a folded portion is formed, the folded portion being folded into halves and interposed between the layers, the longitudinal folded lines comprising first, second and third folded lines, the first folded line extending near a first side edge of panel material, the longitudinal folded back lines comprising first and second folded back lines, the first folded back line extending between the first side edge of panel material and the first folded line, the second folded back line extending between the second and third folded lines, the web of panel material being folded along the first folded line and folded back along the first folded back line so that one of the folded portions is formed near the first side edge of panel material, the web of panel material being further folded along the second folded line, folded back along the second folded back line and folded along the third folded line so that the other folded portion is formed;

slitting the web of panel material along the first, second and third folded lines into the folded portions and two divided parts after being folded and folded back, to make the folded portions and the divided parts divided from each other;

guiding the divided parts when being fed to be separated and spaced from each other, fed as they are and then superposed with each other;

fixing the folded portions and one of the divided parts to each other temporarily along slit lines after the divided parts are separated, to have temporarily fixed portions and unfixed portions formed alternately along the slit lines, the folded portions being then fed by the temporarily fixed portions;

splitting the folded portions at the unfixed portion into split portions, and removing the folded portions at the unfixed portion partially after the divided parts are separated and spaced from each other so that the split portions are spaced from each other;

supplying a body of zipper material onto the one of the divided parts to extend widthwise thereof, the body of zipper material being disposed between the split portions, the body of zipper material being then interposed between the divided parts when the divided parts are superposed with each other;

heat sealing the divided parts with each other longitudinally thereof after being superposed with each other; and heat sealing the divided parts and the body of zipper material with each other widthwise of the divided parts after the divided parts are superposed with each other, the panel portions, the side gusset portions and the zipper portion being formed by the divided parts, the folded portions and the body of zipper material.

2. The method as set forth in claim 1 wherein the web of panel material is firstly folded along the first folded line, folded back along the first folded back line, folded along the second folded line and folded back along the second folded back line, the web of panel material being then folded along the third folded line.

* * * * *